US007458474B2

(12) United States Patent
Bewsky

(10) Patent No.: US 7,458,474 B2
(45) Date of Patent: Dec. 2, 2008

(54) BULBOUS PIN IMPLEMENT HOLDER AND TIP PROTECTOR FOR VARIOUS SIZED IMPLEMENTS

(76) Inventor: Conrad Wayne Bewsky, 4084 Brandon Street, Burnaby, British Columbia (CA) V5G 2P8

( * ) Notice: Subject to any disclaimer, the term of this patent is extended or adjusted under 35 U.S.C. 154(b) by 182 days.

(21) Appl. No.: 11/361,736

(22) Filed: Feb. 23, 2006

(65) Prior Publication Data

US 2006/0186068 A1 Aug. 24, 2006

Related U.S. Application Data

(60) Provisional application No. 60/656,166, filed on Feb. 24, 2005.

(51) Int. Cl.
*A47F 7/00* (2006.01)

(52) U.S. Cl. ..... 211/69.1

(58) Field of Classification Search ..... 211/69, 211/69.1, 69.5, 69.9, 69.8, 70.7; D19/82
See application file for complete search history.

(56) References Cited

U.S. PATENT DOCUMENTS 648,928 A * 5/1900 Davis ..... 206/207
1,092,156 A 4/1914 Mathis
1,463,805 A * 8/1923 Faber ..... 211/69.1
1,641,829 A * 9/1927 Sheaffer et al. ..... 211/69.5
2,322,797 A * 6/1943 Fishel ..... 211/69
2,511,735 A * 6/1950 Patterson ..... 211/69.8
2,636,615 A * 4/1953 Bradley ..... 211/69.8
3,182,808 A * 5/1965 Benoit et al. ..... 211/69.8
4,519,498 A * 5/1985 Booth ..... 206/214
4,858,302 A * 8/1989 Stribiak ..... 483/3
5,525,314 A * 6/1996 Hurson ..... 422/300
5,681,539 A * 10/1997 Riley ..... 422/300
5,775,518 A * 7/1998 Connor ..... 211/70.7
6,082,559 A * 7/2000 Levsen ..... 211/70.7
6,202,862 B1 * 3/2001 Acquaviva et al. ..... 211/69.5
6,685,034 B1 * 2/2004 Cooke ..... 211/40
6,745,907 B2 * 6/2004 Kjelgaard ..... 211/69.5
7,303,493 B1 * 12/2007 Ehresman ..... 473/386

* cited by examiner

*Primary Examiner*—Jennifer E. Novosad
(74) *Attorney, Agent, or Firm*—Smiths IP; Lawrence Chan

(57) ABSTRACT

An apparatus is disclosed for an implement retainer comprising a holder having a base and a plurality of flexible pins projecting from the base. The holder is flexible and manufactured of a resilient material. The pins have bulbous, conical, convex tips, and holes may be disposed between the pins to isolate and suspend the pointy tips of implements. The pins also have a frusto-conical convex base which guides and retains the end of an implement. A low bridging wall is provided between each adjacent pin which guides an implement tip into the hole and also retains the end of an implement. In use, implements are inserted between the pins and contact against the bulbous, convex tip of the pins, which are displaced by the implement, then press against the implement, thereby retaining the implement in place.

13 Claims, 9 Drawing Sheets

BULBOUS PIN IMPLEMENT HOLDER AND TIP PROTECTOR FOR VARIOUS SIZED IMPLEMENTS

CROSS-REFERENCE TO RELATED APPLICATIONS

This application claims the benefit of: Provisional Application for Patent No. U.S. 60/656,166 Filing Date Feb. 24, 2005

STATEMENT REGARDING FEDERALLY SPONSORED RESEARCH OR DEVELOPMENT

Not Applicable

REFERENCE TO SEQUENCE LISTING, A TABLE, OR A COMPUTER PROGRAM LISTING COMPACT DISC APPENDIX

Not Applicable

BACKGROUND OF THE INVENTION

The present invention relates generally to storage holders for hand held implements and small objects. More specifically, a resilient multiple pin holder for accessibly retaining hand-held implements and small objects vertically, horizontally or at an angle, has holes to isolate and retain the tip of the implements, retains implements in the orientation in which they are inserted, can accommodate different sized implements, has structure which aids guidance of the implement into the holder, and is easily cleaned.

When an implement such as a pen, being of sufficient weight, is placed directly into a storage container, such as a commonly used pencil holder, the ball in the tip of the pen is depressed causing the pen to leak ink. The ink dries in the tip of the pen or on the ball of the pen causing the pen to skip rendering it useless. Ink may also leak from defective pens. Ink collects in the bottom of the pencil holder and mixes with dust contaminating the pencil holder. Implement tips freely move around in the pencil holder and become contaminated with ink and dust. When the need arises, an implement such as a pen or a pencil is removed from the pencil holder. With its tip contaminated with ink and dust, ink blobs are then transferred to the intended work surface thus causing smears and smudges. Presently materials such as paper towel and napkins are placed in the bottom of containers such as cups, cans or specifically manufactured pen and pencil holders to absorb leaking fluids from implements such as pens. This helps but does not eliminate the problems.

Another common problem in present implement storage containers is the damaging impact to the tip of implements such as pens and pencils when they are dropped onto hard surfaces such as the inside bottom of the storage containers.

The design and physical properties of the present invention prove to be beneficial in such a way that they eliminate the damaging impact that occurs to the tip of an implement such as a pen or a pencil when the implement is dropped onto a hard surface, such as into a storage container manufactured of materials such as hard plastic, metal, glass, ceramic or like. The present invention isolates and suspends the tips of implements by holding and supporting the implements vertically without the use of a storage container, eliminating pressure on pen tips, eliminating pencil tip breakage and eliminating ink build up on pen and pencil tips which can cause ink smudges on writing surfaces or documents and eliminates cross contamination of liquid ink or water thin ink pens. The present invention eliminates the problems described herein and greatly reduces overall costs such as damaged or destroyed documents and damaged expensive pens.

Mats having a plurality of vertically projecting pins have been used for many years to store small objects. U.S. Pat. No. 1,931,398 to Smith, Oct. 17, 1933, disclosed a coin mat which was thin and had relatively small pins which made it easier to pick coins off of the mat. The mat was also designed to avoid the mat slipping on a counter.

U.S. Pat. No. 6,048,504 to Riley, Apr. 11, 2000, disclosed a silicone mat with widely spaced pins on a mesh backing for use with a sterilization tray. U.S. Pat. No. 5,766,561 to Frieze et al., Jun. 16, 1998, disclosed a silicone mat with raised ribs on the bottom surface of the mat and a series of fingers or projections on the top surface, with holes perforating the mat for use in a sterilization tray. The fingers or pins in the Riley and Frieze Patents are small and insubstantial, with a uniform profile, and intended only to support medical instruments in place horizontally during the sterilization process.

Pin mats have been used extensively in sterilization trays for supporting surgical tools. U.S. Pat. No. 5,407,648 to Allen, Apr. 18, 1995, disclosed a tray and mat combination for the sterilization of medical instruments having a series of raised ribs and widely spaced pins to retain medical instruments placed on their sides on the mat. A relatively low number of holes compared to pins were formed in the silicone mat to allow the passage of sterilants.

U.S. Pat. No. 6,202,862 B1 to Acquaviva et al., Mar. 20, 2001, disclosed a pen holder molded in foam having six tapering cavities to engage and hold upright pens and other writing implements. The cavities are spaced a considerable distance apart and the top surface of the holder is reasonably flat providing no guidance for the implement tip into the cavity. The cavities have closed bottoms resulting in difficult cleaning practices and the pooling of ink from the leaking writing implements.

U.S. Pat. No. 1,092,156 to Mathis, Apr. 7, 1914, disclosed a pencil holder having a top perforated surface which pencil tips pass through and a bottom perforated disinfecting tablet or pad through which pencil tips project. A considerable amount of space between the top surface of the holder and the top surface of the pad in conjunction with the spaces between the holes and the reasonably flat top surface of the pad provide no guidance of the pencil tip into a hole.

Apparatuses for holding small implements vertically have included empty cups, specific containers and foam blocks. Foam blocks having small holes have been used to retain hand held implements such as screwdrivers, pens and pencils. Conventional cup type holders have the disadvantage of the weight of the pen depressing the ball in the tip causing ink to leak into the holder. Depression of the ball or roller can also cause ink to dry on parts of the ball or roller causing the pen to skip when in use. The tips of pencils are easily broken off in conventional holders.

An implement holder is required which overcomes the disadvantages of the prior art by providing a resilient holder that can support implements in the orientation in which they are inserted, can accommodate different sized implements, has structure which aids guidance of the implement into the holder, has holes to isolate the tip of the implements and is easily cleaned.

BRIEF SUMMARY OF THE INVENTION

It is an object of the present invention to provide a holder for implements that overcomes many disadvantages of the prior art.

Another object of the present invention is to provide an implement holder which provides positive guidance of an implement tip into a disposed hole in the implement holder to prevent damage to the implement tip.

Another object of the present invention is to provide a holder for retaining implements in the orientation in which they are inserted into the holder.

A further object of the present invention is to provide a multiple pin holder for retaining writing implements vertically to avoid pressure on the tips of implements.

Other objects of the present invention are to provide an implement retainer which is durable, retains various sized implements; isolates the tips of implements, retains leaking fluids and is easy to clean.

In accordance with the present invention an object retainer is disclosed having a base, a plurality of pins projecting upwards from the base, a plurality of holes disposed between the pins in the base and a low bridge between the base of each adjacent pin.

Advantageously, the pins may have a wide base, a narrower middle section which widens to a relatively large diameter top section, which finally narrows to a pointed tip such that objects are guided to the central space equidistant from the surrounding pins.

Preferably, the pins are arranged in a triangular or staggered grid pattern with one hole in the center of each group of three pins.

Other variations of the invention include disposing the pins in concentric circles groups of four pins or an irregular pattern.

Advantageously, the holder may be placed on a flat surface, or mounted on a wall or other angled surface.

Further advantages of the invention will become apparent when considering the drawings in conjunction with the detailed description.

BRIEF DESCRIPTION OF THE SEVERAL VIEWS OF THE DRAWINGS

For a better understanding of the invention, its principles and its application, reference should be made to the following detailed description and accompanying drawings in which.

DETAILED DESCRIPTION OF THE INVENTION

Figure 1:
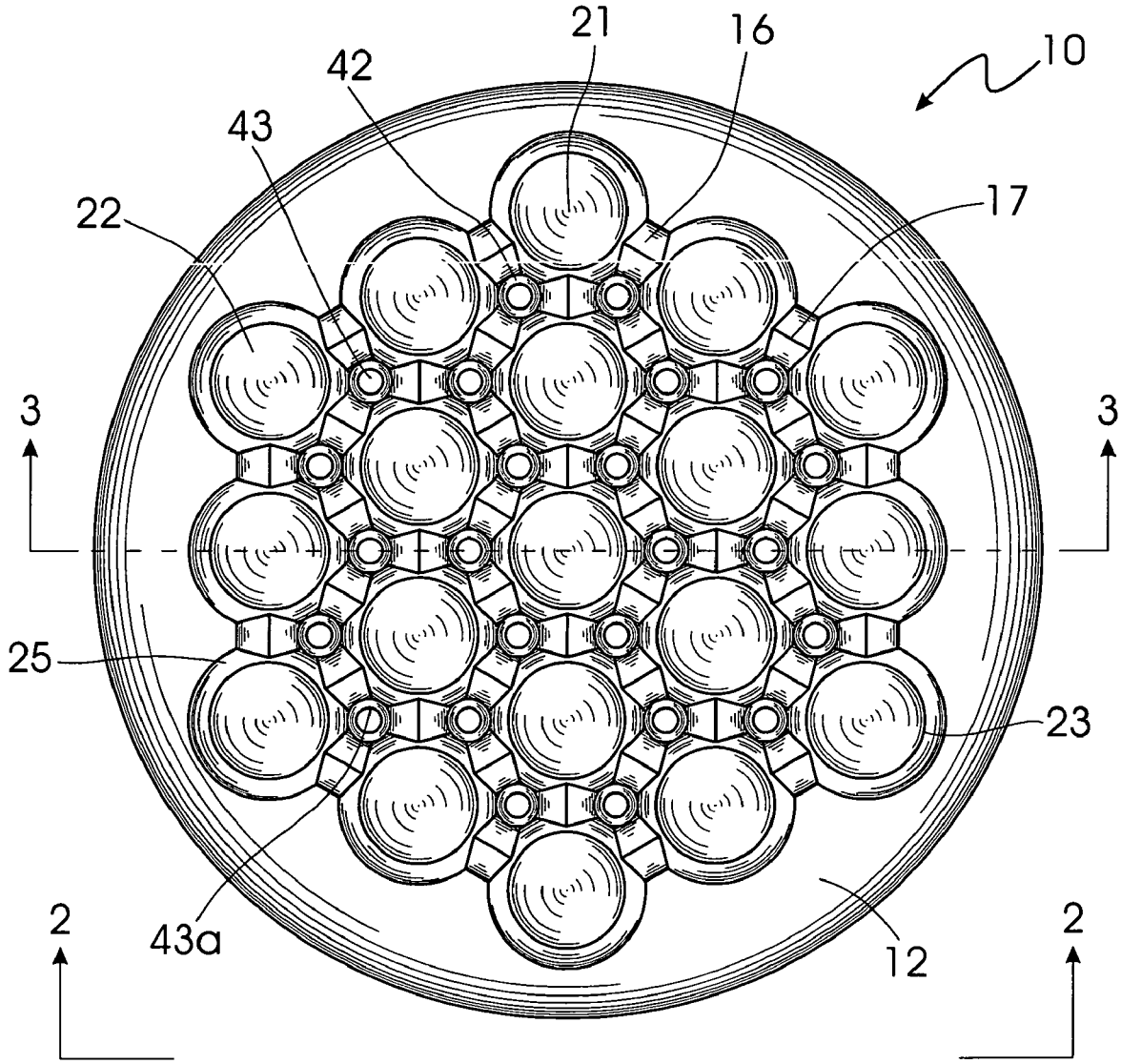
FIG. 1 is a top plan view of the present invention.
Figure 2:
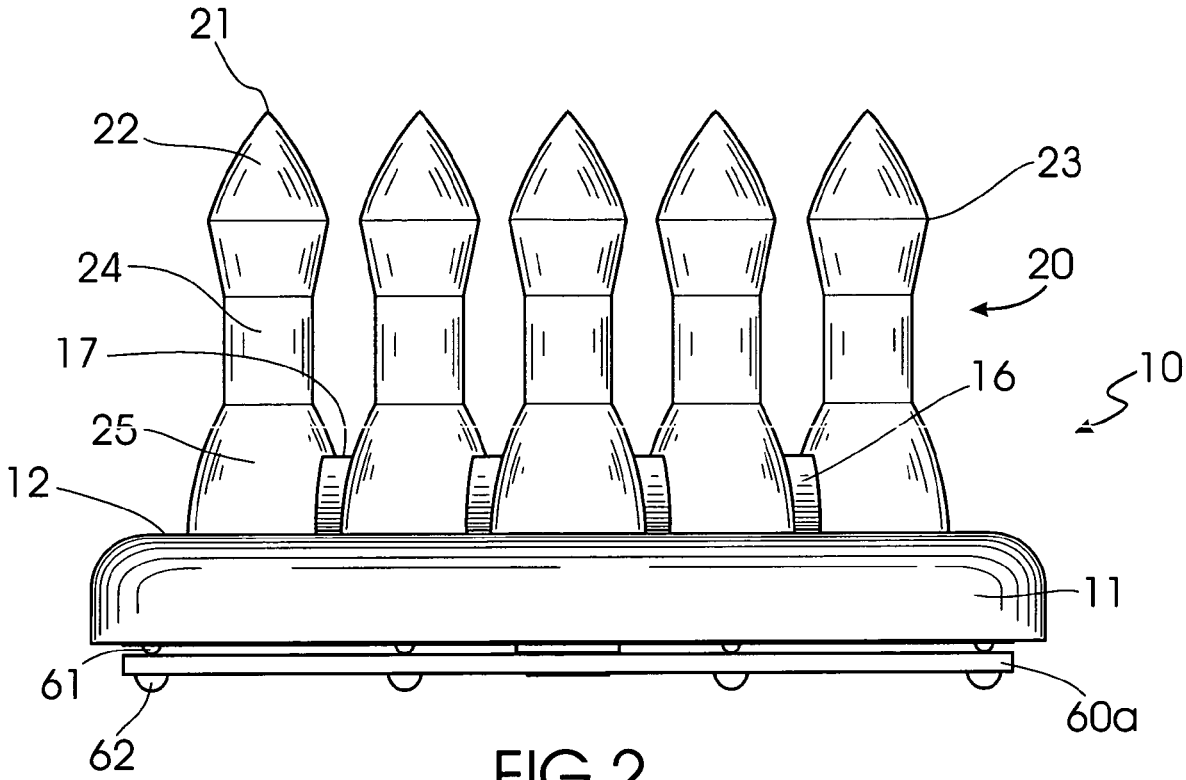
FIG. 2 is a front view of the present invention taken along line 2-2 in FIG. 1.

Referring to FIG. 1 of the drawings, the present invention described and illustrated herein as an example, a pin or finger implement holder indicated generally at 10 is shown. Referring to FIGS. 1 and 2, the holder 10 comprises a preferably circular base 11, having a substantially flat top surface perforated by holes 43 and a substantially flat bottom surface having a cavity recessed in its surface and perforated by holes 43. The holder has a multiplicity of pins 20 protruding vertically from the top surface 12 of the base 11 of the holder 10, bridges 16 between the pin bases 25 and a hole 43 in the center of each triangular group of three pins 20. Alternatively the base of the holder may have an irregular top surface and may be of shapes such as oval or rectangular. Optimally, the pins 20 are arranged in a staggered or equilateral triangular grid pattern, with one hole 43 in the centre of each triangular group of three pins, and are substantially close together. Alternatively, the base of the pins may be touching or overlapping each other similar to FIG. 9. The pins 20 may be arranged in various patterns such as groups of four or more pins, irregular or concentric circles.

The pins 20 comprise of a generally frusto-conical convex base 25 which has a large enough bottom diameter to completely terminate around the top edge of the hole 43. The pin base gradually decreases in diameter to a smaller diameter cylindrical mid section or stem 24, which gradually increases in diameter to an enlarged top section 22, the top section having a convex conical curvature which gradually decreases in diameter terminating in a point 21 at the top of the pin. The convex curvature of the outer surface of the pin base 25 and enlarged top section 22, and the curvature of the outer surface of the bridge 16 are necessary to effectively deflect implements and provide minimal contact between the implement and the holder 10. The enlarged pin tops 22, pin bases 25 and bridges 16 may have a flat outer surface rather than a convex or curved surface and may be smooth or of a texture. The pins 20 may be hollow. The outer edge 23 of the enlarged top 22 of the triangular group of three pins 20 are located slightly closer to each other than the diameter of the implement for which the holder is intended. To be most effective, the implement must displace the top of each adjacent pin to be retained securely. The pin contours are essential to effectively guide implements to the center of the space between groups of three adjacent pins with little resistance and retain the implements.

A multiplicity of holes 43 in the base 11 of the holder 10 are also arranged in an equilateral triangular grid pattern, there being one hole 43 in the centre of every triangular group of three pins 20.

A low bridge 16 between each pin 20, comprising of two sloped or angled surfaces apart at the base of the bridge 16 and adjoined at the top of the bridge 16 forming a peak 17, protrudes upwards from the top surface 12 of the base 11 of the holder 10 to a substantial point 17. The ends of the bridge 16 abut the base 25 of each adjacent pin 20. The wide bottom of the bridge 16 is at least wide enough to completely terminate around the top edge of the hole 43. Optimally each side or slope of the bridge is slightly bowed outward. The bridges 16 and pin bases 25 thereby define a generally annular ring about the edge of each hole 43. The holder 10 is generally fabricated of a pliable resilient material such as Dynaflex®, silicone, neoprene, PVC, Santoprene® or polyurethane. Optimally the holder would be fabricated of Dynaflex®. The holder can be processed in a variety of shapes and sizes. The preferred manufacturing process is injection molding making it economical to produce.

Figures 3A, 3B:
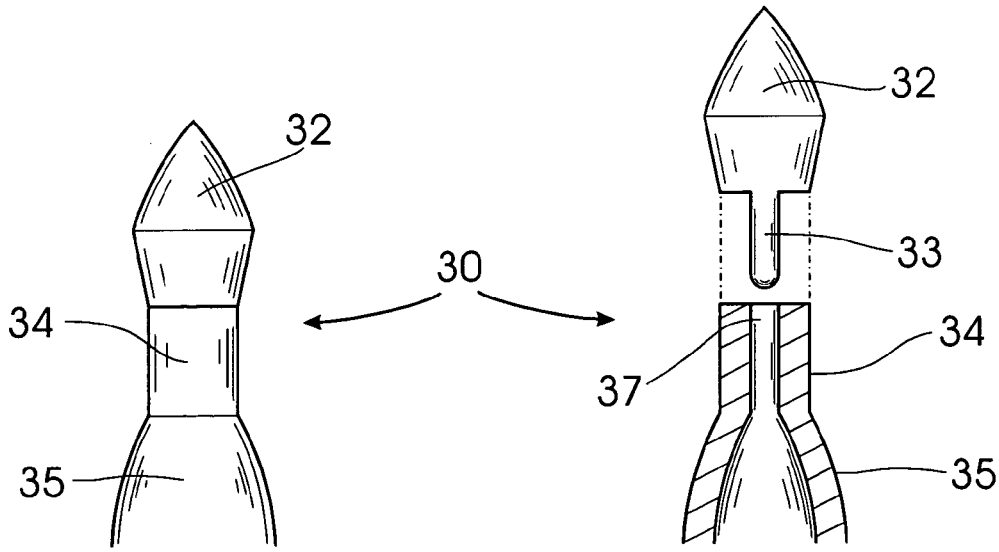
FIG. 3A is a front view of a pin assembly, a variation of a pin shown in FIG. 2.
FIG. 3B is an exploded view of the pin assembly shown in FIG. 3A and a sectional view of the lower portion of the pin.

FIGS. 3A and 3B illustrate a pin assembly 30, a variation of pin 20, comprising of a hollow base 35 and hollow mid section 34 and an attachable enlarged top 32 which may also be hollow. A stem 33 protrudes downwards from the lower portion of the enlarged top 32. The stem 33 of the enlarged top 32 is inserted into the hollow 37 of the mid section 34 of the pin 30. Optionally the stem may have barbs. The enlarged top 32 may be fabricated of a much less pliable material or of thermoplastic resins such as Acrylonitrile Butadiene Styrene (ABS), polyethylene, polypropylene or polystyrene. Preferably the enlarged tops 32 would be fabricated of polyethylene.

Figure 4A:
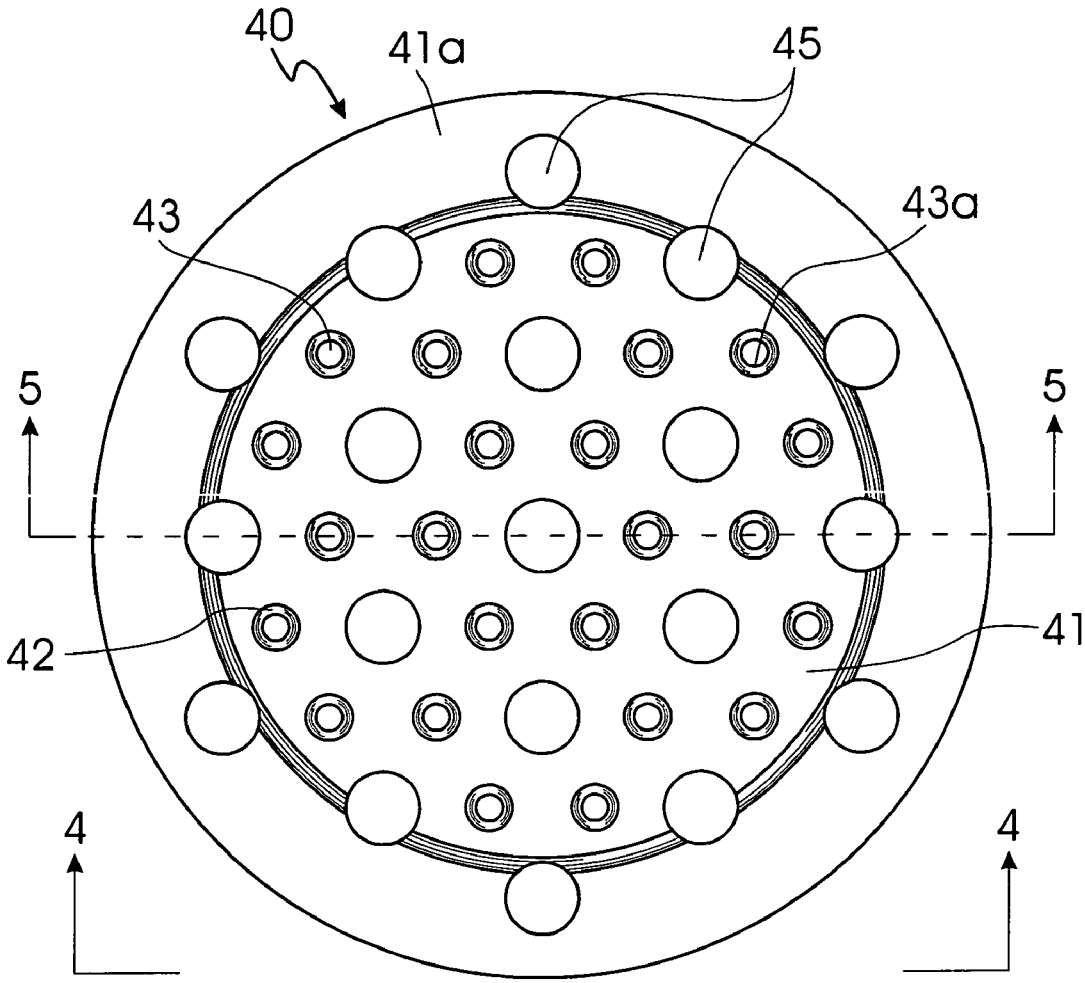
FIG. 4A is a top plan view of the structural plate of the present invention.
Figure 4B:
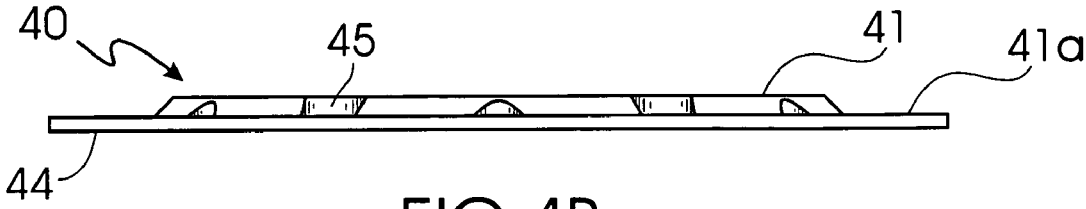
FIG. 4B is a front view of the structural plate taken along line 4-4 in FIG. 4A.
Figure 4C:
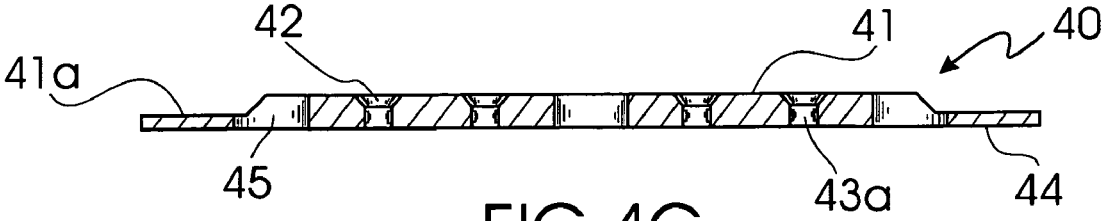
FIG. 4C is a sectional view of the structural plate taken along line 5-5 in FIG. 4A.
Figure 5:
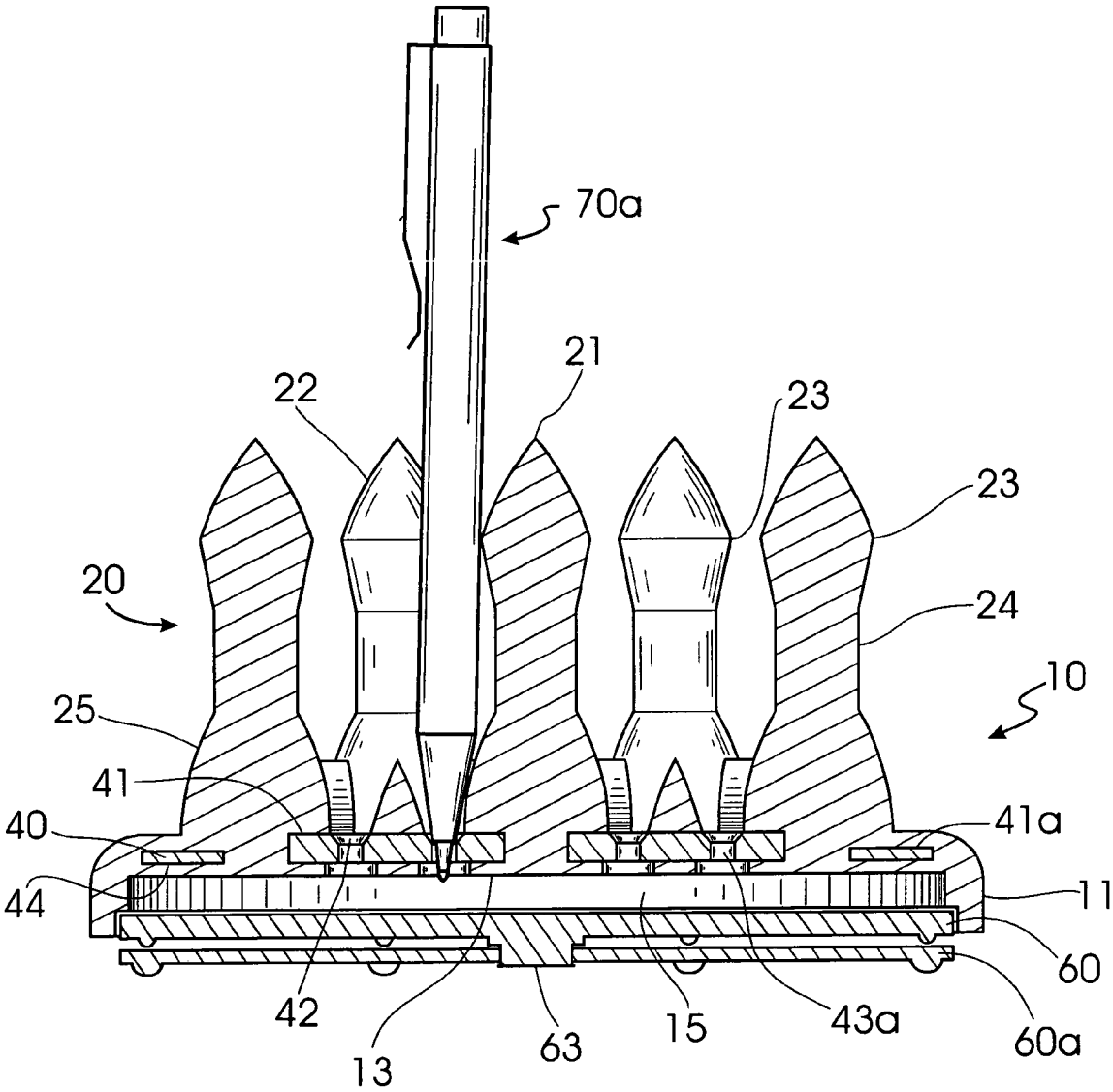
FIG. 5 is a sectional view of the present invention taken along line 3-3 in FIG. 1 in use with a pen inserted therein.
Figure 6A:
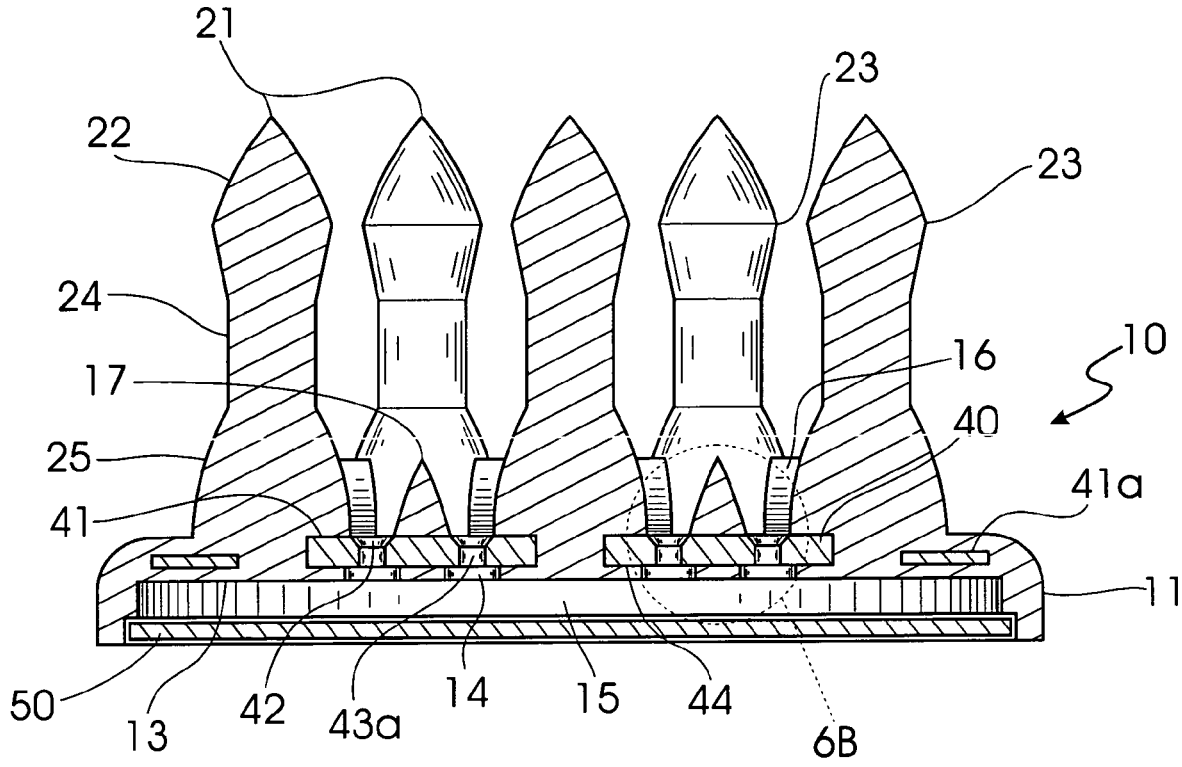
FIG. 6A is sectional view of a variation of the present invention similar to FIG. 5
Figure 6B:
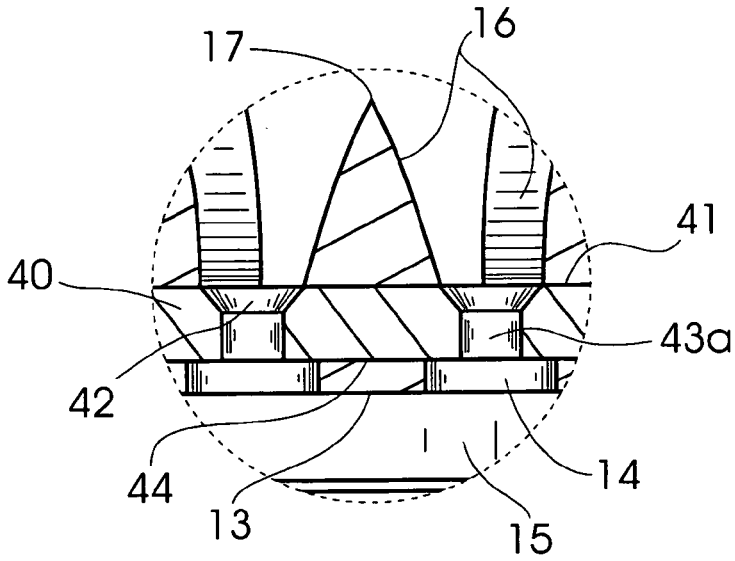
FIG. 6B is an enlarged sectional view of a portion of FIG. 6A.

FIGS. 4A, 4B and 4C illustrate a structural plate or insert 40 comprising of a substantially flat bottom surface 44 perforated by holes 43 and 45 and a substantially flat top surface 41 also perforated by holes 43 and 45. The structural plate is reduced in thickness at the outer edge resulting in a thinner band 41a around the outer edge of the insert. A multiplicity of structural holes 45 in the structural plate 40 having a smaller diameter than the diameter of the bottom of the pin base 25, are placed in an equilateral triangular grid pattern. Each hole 45 is centered directly under each pin 20 of the holder 10 allowing the material the holder 10 comprises of to flow through the holes 45 during the injection mold process providing a mechanical bond of the insert 40 to the holder 10. A multiplicity of holes 43 in the structural plate 40 are placed in an equilateral triangular grid pattern, each hole 43 being centered between every triangular group of three pins 20. The holes 43 comprise of a frusto-conical section with the face 42 of the conical section having at least one angle starting at the top surface 41 of the insert 40 and tapering down into the insert 40 sufficiently, at which point the smaller diameter of the frusto-conical section conjoins the cylindrical section 43*a*. The cylindrical section 43*a* continues through the remainder of the insert 40 terminating at the bottom surface 44. The cylindrical section 43*a* of each hole 43 is at least small enough to allow only the tip of an implement such as a pen or pencil to pass through. The cylindrical section may be slightly tapered. The degree of the angle or angles of the face 42 of the frusto-conical section will vary depending on the thickness of the insert 40 and length of the cylindrical section 43*a*. The face 42 of the frusto-conical section may be convex or concave, smooth or of a texture. The structural plate 40 is overmolded in the base of the holder to provide a structural frame for the holder and a positive stop for the implement tips as shown in FIGS. 5, 6A and 6B. The insert 40 is preferably fabricated of a generally rigid material of sufficient mass and physical properties. This would prevent the implement holder from distortion caused by such conditions as heat or the weight of the implements placed therein or thereon. Suitable fabricating materials of the structural plate may include metal, fiberglass or preferably thermoplastic resins such as Acrylonitrile Butadiene Styrene (ABS), polypropylene, polystyrene and polyethylene. Optimally the structural plate would be fabricated of ABS. The preferred manufacturing process is injection molding making it economical to produce.

Figure 7:
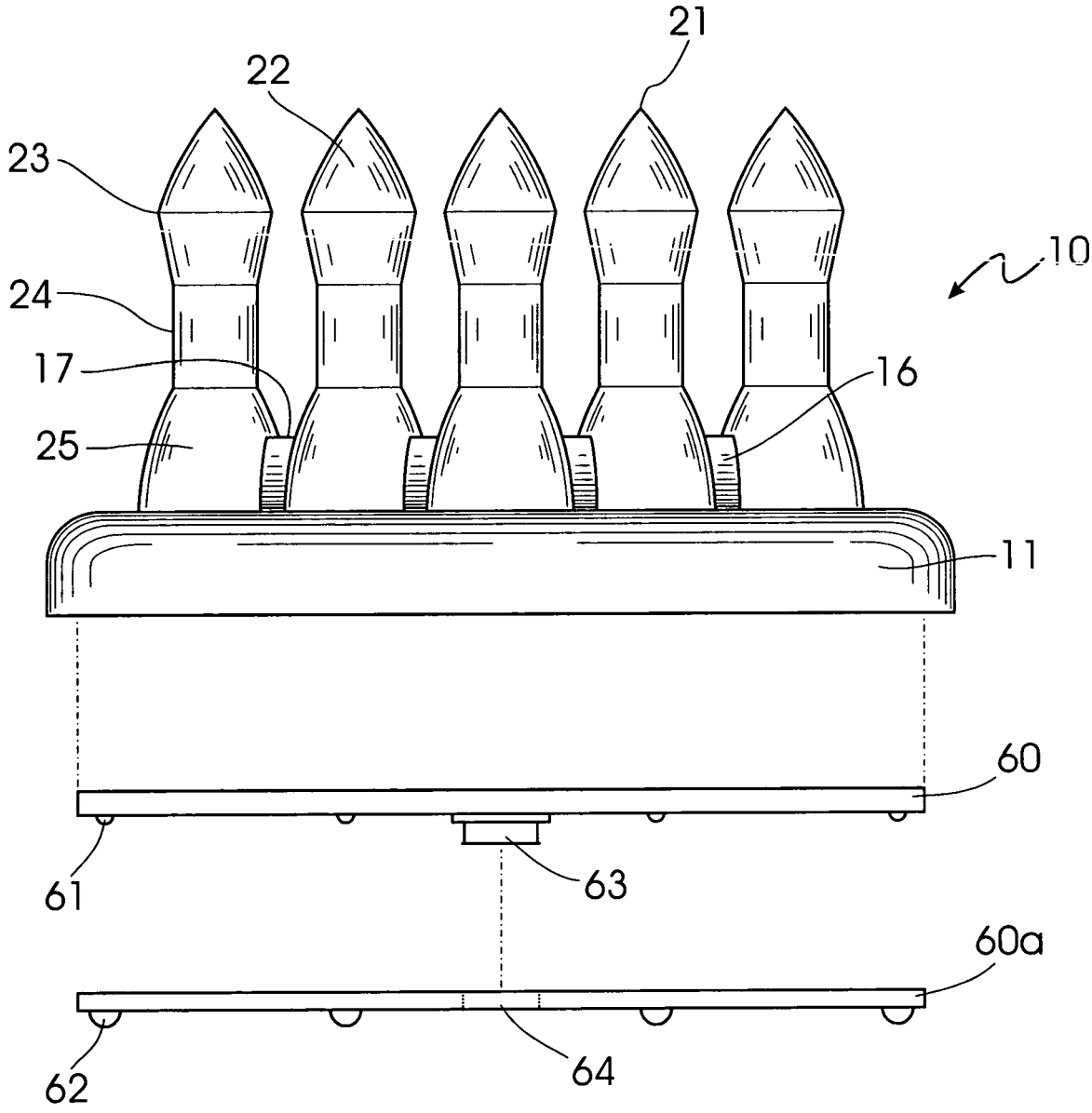
FIG. 7 is an exploded view of the present invention shown in FIG. 2.

FIGS. 2, 5 and 7 illustrate a swivel plate assembly comprising of a substantially flat upper plate 60 having a central pivot point 63 and antifriction pins 61 protruding from the bottom surface of the upper plate, the antifriction pins 61 are spaced evenly about but slightly in from the outer edge of the upper plate, and a substantially flat lower plate 60*a* having a hole 64 in the center and non-skid pads 62 placed on the bottom surface of the lower plate and are also spaced evenly about but slightly in from the outer edge of the lower plate. The non-skid pads 62 comprise of a pliable material similar to the material the holder 10 is fabricated of such as PVC. Alternatively an anti-skid ring of a pliable material similar to the implement holder material such as PVC would be overmolded around the edge of the lower plate. Optionally the upper plate may have an upstanding wall around the perimeter of the plate, molded as part of the upper plate. This would require the upper plate to be inserted up into the holder base cavity with the rim of the upper plate abutting the underside of the holder base. Suitable fabricating materials of the upper and lower plate may include metal, fiberglass or preferably thermoplastic resins such as Acrylonitrile Butadiene Styrene (ABS), polypropylene, polystyrene and polyethylene. Optimally the upper and lower plate would be fabricated of ABS. The preferred manufacturing process is injection molding making it economical to produce. The swivel plate assembly may be a commercially available assembly sized for the holder.

FIG. 5 shows an implement such as a pen 70*a* with its tip being supported in the structural plate 40 isolating the tip from the holder 10, while the upper portion of the pen 70*a* is being supported by the largest diameter 23 of the enlarged tops 22 of the pins 20.

Figure 8:
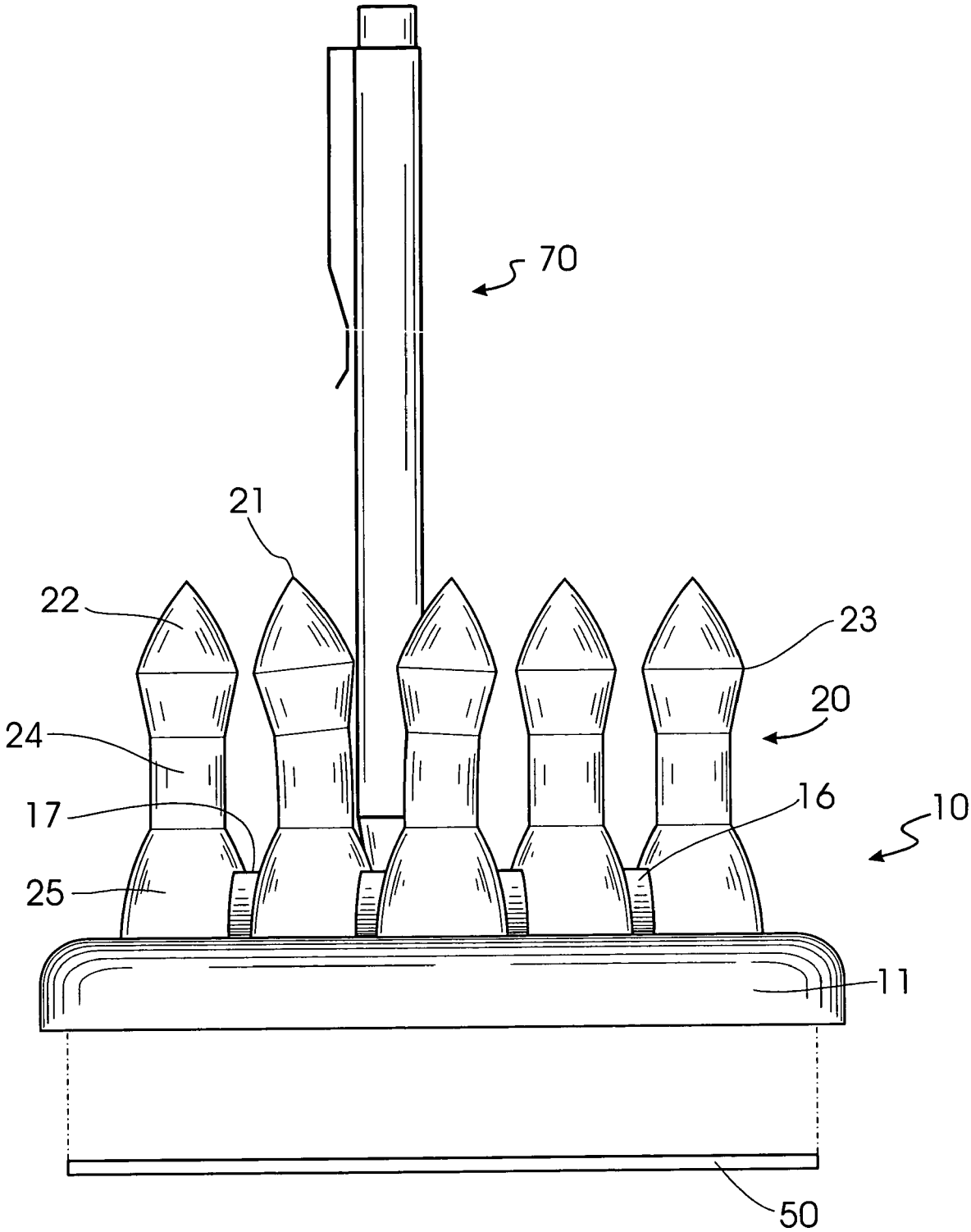
FIG. 8 is an exploded view of a variation of the present invention, similar to the present invention shown in FIGS. 2 and 6A in use with a pen inserted therein.

In use, as shown in FIGS. 5 and 8 as an example, the implement holder 10 is placed in an upright position on a suitable supporting surface such as a desk top (not shown). An implement such as a pen 70 or 70*a* is directed point first towards the implement holder 10 in a substantially vertical downward motion coming in contact with the convex conical curvature portion of the enlarged top 22 of at least one pin 20. With further downward motion the pen tip is guided to the central position of the triangular group of three pin tops 22. With the diameter of the pen body being larger than the space between the three adjacent pin tops 22, the enlarged tops 22 and a portion of the adjoining stems 24 are displaced laterally. The resilient pin 20 material creates pressure against the implement. The pen 70 or 70*a* continues in a downward motion sliding directly into the hole 43 or coming in contact with either the outer curvature of the bridge 16 or the outer curvature of the pin base 25, freely sliding down either surface to be substantially centered between the three adjacent pin bases 25 and coming in contact with the conical surface 42 of the hole 43 freely sliding down the conical surface 42 being guided into the hole 43. The pen 70 or 70*a* is released and is retained in the holder in the orientation in which it was inserted. The implement is held securely in the holder as there are two areas of substantial contact, one at the tip of the implement and the other area having multiple points of contact which are the outermost edge 23 of the three adjacent enlarged pin tops 22 on an upper portion of the pen body. An implement having a blunt tip, such as a capped pen, would come to rest against the curvature of the base of the pins or the curvature of the bridges depending on its tip diameter. The outer curvature of the pin bases 25 and bridges 16 is necessary to minimize contact between the implement tip and the holder 10 to provide ease of release.

In the event of leakage from an implement such as a pen, ink collects on the top surface of the upper swivel plate 60 which is fitted in the cavity 15 of the holder base 11 preventing leakage onto the surface on which the holder 10 is placed. In a variation of the preferred embodiment, the cover plate 50 performs the function of the upper plate of the swivel plate assembly 60. In any event, fluid cannot collect on the tips of the implements as the tips are suspended by the upper edge of holes 43. Ink contaminated implement tips are therefore eliminated. The majority of the implement will remain above the top of the pin tips, and therefore is readily accessible for future withdrawal and use. This configuration prevents unnecessary pressure on the ball or roller of a pen tip and eliminates the impact on pen and pencil tips which can cause damage to the tips.

FIGS. 6A and 8 illustrate a cover plate 50 which covers the underside 13 of the holder 10. The cover plate consists of a rigid material similar to the material used to fabricate the structural plate and swivel plates such as ABS. The underside 13 of the base 11 of the holder 10 is recessed providing a cavity 15 for the implement tips being stored in the holder 10 and to retain fluids. Cavities 14 in the pliable material of the underside 13 of the holder base 11 expose the bottom of the structural plate 40 defining an annular ring about each implement tip hole 43, each cavity 14 being centered between each triangular group of three pins 20. This provides clearance between the implement tip and the underside 13 of the holder 10 when the implement is inserted therein.

FIG. 6B is an enlarged view of the implement tip hole 43 in the holder 10 clearly showing the pliable material of the holder 10 terminating at the top edge of the hole 43.

Figure 9:
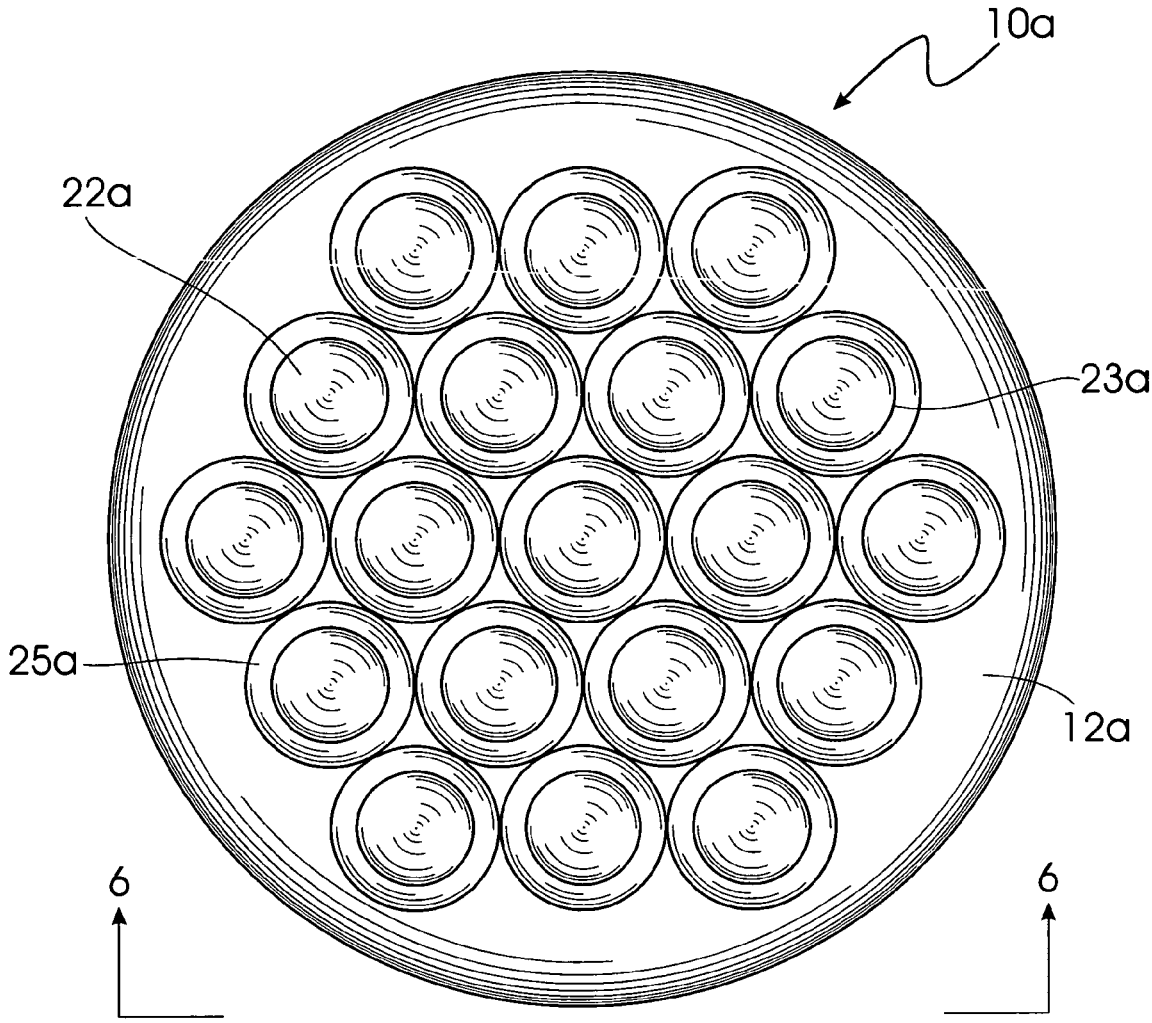
FIG. 9 is a top plan view of a variation of the present invention similar to the present invention shown in FIG. 1.
Figure 10:
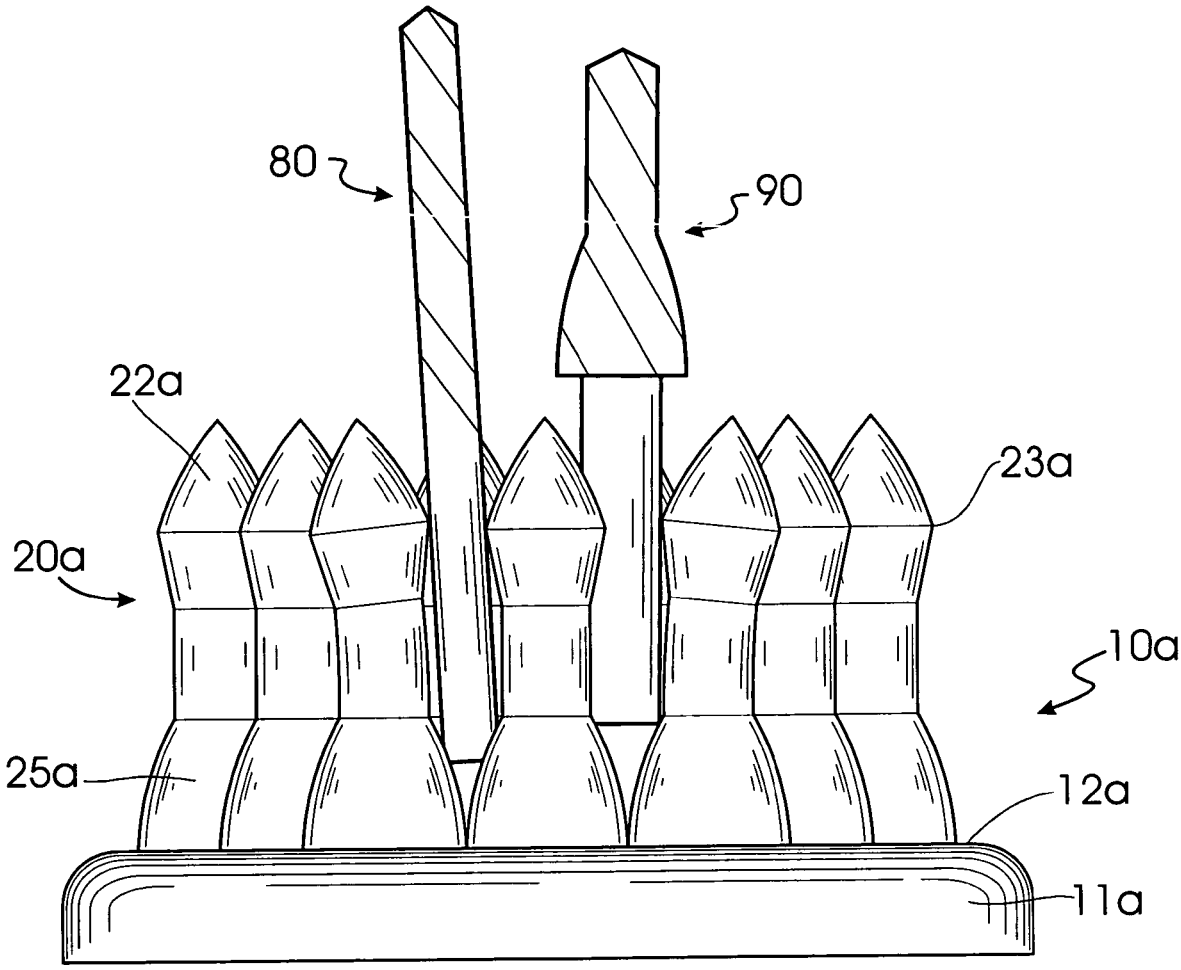
FIG. 10 is a front view of the variation of the present invention taken along line 6-6 in FIG. 9, in use with various sized objects inserted therein.

FIGS. 9 and 10 illustrate another embodiment 10*a* similar to the preferred embodiment 10 having a multiplicity of pins 20*a* similar to pins 20 protruding from the top surface 12*a* of the holder base Ha placed in a similar equilateral triangular grid pattern as holder 10 having a closer equidistant spacing between pins 20*a*, resulting in the bottom of each pin base 25*a* abutting the adjacent pin bases 25*a*. The holes 43 and bridges 16 are eliminated. The intended use of this type of implement holder is to retain blunt objects such as drills 80 and 90, router bits, nut drivers, batteries and implements that must be capped such as markers.

In use, an implement such as a drill 80 or 90 having a blunt end is inserted in the same manner as pen 70 or 70*a* and comes to rest against the outer curvature of the pin bases 25*a*. The upper portion of the drill is held securely by the outermost edge 23*a* of the enlarged pin tops 22*a*.

The contour of the flexible pins and their arrangement described herein provide superior guidance of an implement tip into the holder, provide minimal contact between the implement and the holder yet retain the implement sufficiently, provide storage of various sized implements in the same holder, and keep implements organized and easily accessible.

The upper and lower portions of the implement tip holes and the bridges described herein also provide superior guidance of an implement tip into a hole, prevent damage to the tips of implements stored, isolate the implement tip from the holder and reduce the need for capping most pens.

Implements such as pens, pencils, crayons, markers, router bits, drills, small tools, dental and medical implements may be stored in the holder.

The holder may come in any size to accommodate many implements or a few implements, or may be customized to include two or more different arrangements of pins, for example three arrangements, one at each end of the holder and one in the middle. The first arrangement having less equidistant space between the pins than the second arrangement, and the second arrangement having less equidistant space between the pins than the third arrangement. This would enable the user to store for example, "AAA" and "AA" batteries in the first arrangement, "C" batteries in the second arrangement and "D" batteries in the third arrangement increasing the versatility and usefulness of the holder.

In additional variations, the pins may project at any oblique angle to the base therefore supporting and retaining implements at any angle. The pins may be elongated and less flexible for heavier objects such as paintbrushes, screwdrivers, punches, wrenches and other tools and implements.

In operation the holder is quick and easy to insert objects into and remove objects from and can be used one handed. A pen for instance typically has a cap which requires the user to hold the cap in one hand and the pen in the other snapping them together. The holder replaces the cap function of protecting the tip of the pen providing the advantage of single handed access.

The unique design and spacing of the pins permit the storage of different sized implements in the same holder, supporting their tips and maintaining proper support of the upper portion of the implement. For example, with the pins arranged in a specific equilateral triangular grid pattern in the same holder in conjunction with a specific pin sizing, it is possible to store an implement one quarter inch in diameter as well as an implement five eights of an inch in diameter in the same holder. The reason being, with the pins' enlarged tops and a portion of the stems being displaced laterally the widest diameter of the enlarged tops of the pins maintain contact on the implement body while the tip of the implement is retained in the hole or by the curvature of the bridges, curvature of the pin bases or lower portion of the stems.

If the implement body diameter is smaller than the space between the enlarged tips of a triangular group of three pins, the implement is retained sufficiently by the upper portion of the tip of the implement being supported by the annular ring defined by the three bridges connecting the bases of the three pins around each hole in conjunction with the point of the implement tip being supported in the hole.

The implement tip holes and structural holes in the structural plate may be of other shapes such as square, hexagon or triangular.

The fingers or pins protruding from the top surface of the holder base may be of different diameters, lengths and stiffness to hold much larger heavier objects or smaller lighter objects. The overall physical size and properties of the holder may be smaller or larger to suit the type and weight of the objects or implements being stored.

The fingers or pins protruding from the top surface of the holder base may be of other cross sectional shapes other than round, such as square, hexagon or triangular.

The optimal overall size of the pin, the equidistance between the pins, the diameters and length of the frusto-conical convex pin base, the diameter and length of the pin stem, the diameters and length of the frusto-conical lower section of the enlarged top, the diameter and length of the convex conical top of the enlarged top, the curvature of the enlarged pin top and pin base, the flexibility required, the height, width, length and curvature of the bridges, the thickness, shape and size of the holder base, the angle or angles and diameters of the frusto-conical section of the implement tip hole in the insert, the length and diameter of the cylindrical section in the insert, the thickness, shape and size of the insert, and the materials used for fabricating can vary depending on the application of the holder and the size, type and or weight of the implements being stored in or on the holder.

Of the embodiments mentioned, peaks, slopes and curvatures are necessary to provide optimal guidance of the implement tip into the holder and to provide minimal yet sufficient contact on the implement. The holes in the insert are necessary to isolate the tips of the implements being stored. The cylindrical section of each hole is necessary to maintain the specific size of the hole and to minimize implement tip jamming.

The pliable materials mentioned are extremely resilient and durable.

The embodiments described herein by no means limit the present invention to the precise forms disclosed. They have been chosen and described to best explain the principles and practical use of the present invention in it simplest form to enable others skilled in the art to make and use the same. The drawings shall be interpreted as illustrative and not in a limiting sense.

As will be apparent to those skilled in the art, in light of the foregoing disclosure, many alterations and modifications are possible in the practice of this invention without departing from the spirit or scope thereof. Accordingly, the scope of the invention is to be determined by the following claims.

What is claimed is:

1. An apparatus for retaining at least one implement comprising:

a base plate comprising a plurality of holes extending through said base plate, wherein a top portion of each of said plurality of holes is frusto-conical;

a plurality of flexible pins extending substantially perpendicularly from said base plate and arranged around each of said plurality of holes, wherein each of said plurality of flexible pins comprise a pin base, and wherein said pin base comprises a sloped, convex surface;

a plurality of bridging wills, wherein each of said plurality of bridging walls extends between two of said plurality of flexible pins, and wherein each of said plurality of bridging walls is situated on said base plate and comprises a sloped, convex surface; and a structural base attached to a bottom surface of said base plate.

2. The apparatus of claim 1 wherein said structural base comprises a plurality of base holes, wherein said plurality of base holes is aligned with said plurality of holes.

3. The apparatus of claim 1, wherein said plurality of flexible pins is arranged equidistant from each other.

4. The apparatus of claim 3, wherein said plurality of flexible pins is arranged in a triangular pattern.

5. The apparatus of claim 3, wherein said plurality of flexible pins is arranged in a quadrilateral grid pattern.

6. The apparatus of claim 3, wherein each of said plurality of base holes is adapted to suspend a tip of said implement and to prevent said tip from contacting any surface of said structural base.

7. The apparatus of claim 6, further comprising an upper plate of a swivel plate assembly which continuously abuts a bottom outer edge of said structural base.

8. The apparatus of claim 7, further comprising a lower plate of the swivel plate assembly attached to a bottom surface of said upper plate.

9. The apparatus of claim 1, wherein said plurality of flexible pins is arranged in one of the following formations: concentric circles, groups of three, groups of four or irregularly.

10. The apparatus of claim 9, wherein each of said plurality of flexible pins further comprises a bulbous tip and a narrow middle-section.

11. The apparatus of claim 10, wherein said bulbous tip is adapted such that when said implement is inserted between adjacent said plurality of flexible pins, said implement is guided to a central space equidistant from adjacent said plurality of flexible pins surrounding said implement, said pin base is also adapted to guide said implement to said central space and is further adapted to guide a tip of said implement to one of said plurality of holes.

12. The apparatus of claim 11, wherein said bulbous tip further comprises a top section having a sloped, convex outer surface.

13. The apparatus of claim 1, wherein each of said plurality of flexible pins further comprises a resilient material.

* * * * *